United States Patent [19]

McKee et al.

[11] 4,040,702

[45] Aug. 9, 1977

[54] SOLDERLESS TERMINATION SYSTEM

[75] Inventors: William H. McKee, West Covina, Calif.; Roy Witte, Rolling Meadows, Ill.

[73] Assignee: TRW Inc., Elk Grove Village, Ill.

[21] Appl. No.: 730,561

[22] Filed: Oct. 6, 1976

Related U.S. Application Data

[60] Continuation of Ser. No. 589,308, June 23, 1975, abandoned, which is a division of Ser. No. 443,678, Feb. 19, 1974.

[51] Int. Cl.[2] ..... H01R 11/20

[52] U.S. Cl. ..... 339/97 R; 113/119; 29/630 A

[58] Field of Search ..... 339/95 R, 96, 97 R, 339/97 P, 213 R, 213 T; 113/119; 29/630 A

[56] References Cited

U.S. PATENT DOCUMENTS

| | | | |
|---|---|---|---|
| 2,370,725 | 3/1945 | Gordon | 339/213 R |
| 2,501,187 | 3/1950 | Oortgijsen | 339/213 R |
| 3,183,472 | 5/1965 | Pawl | 339/97 P |
| 3,288,914 | 11/1966 | Fuller et al. | 339/97 R |
| 3,514,527 | 5/1970 | Kuo | 339/97 R |
| 3,683,319 | 8/1972 | Vigeant et al. | 339/97 R |
| 3,845,455 | 10/1974 | Shoemaker | 339/97 R |
| 3,867,005 | 2/1975 | Hoppe | 339/98 |
| 3,926,498 | 12/1975 | Hoppe | 339/97 R |

FOREIGN PATENT DOCUMENTS

| | | | |
|---|---|---|---|
| 615,737 | 1/1949 | United Kingdom | 339/95 R |

*Primary Examiner*—Lowell A. Larson

*Attorney, Agent, or Firm*—Neuman, Williams, Anderson & Olson

[57] ABSTRACT

A termination element for electrical connectors and method for making the same. The elements have a wire receiving portion defined by spaced-apart sides in which opposing jaws are formed. The jaws are cut and formed from the sidewalls to present a uniform angular lead-in for the wire being inserted and are spaced and coined to facilitate compression and deformation of the wire upon insertion.

18 Claims, 11 Drawing Figures

SOLDERLESS TERMINATION SYSTEM

This is a continuation of application Ser. No. 589,308 filed June 23, 1975, now abandoned, which is a division of application Ser. No. 443,678 filed Feb. 19, 1974.

BACKGROUND OF THE INVENTION

1. Field of the Invention

This invention relates to a solderless termination system. In particular, it relates to the type of such systems where a wire is engaged and held by blades or jaws. In further particular, it relates to the type of such systems adapted for insulation piercing as well as engaging and holding a wire.

2. Description of the Prior Art

Electrical termination systems are known in myriad forms and sizes. The type of system of interest in the present description provides, as a means for retaining a wire, a pair of facing blades or jaws which may be, before insertion of a wire, in a contact or appropriately spaced apart. Conventionally, blades are adapted to grip a wire between them for mechanical and electrical contact. Often, a lead-in portion is provided where the contact portion of the blades opens to provide convenient positioning and gradual gripping of the wire. Such structures as are shown in the prior art may also enable the insulation surrounding the wire to be pierced as it is inserted between the blades. Common applications of such termination systems are in splicing wires and in the wire terminating end of connectors.

There are a number of factors and problems important in an acceptable insulation piercing solderless termination system. Some of these factors and problems are more pronounced with regard to so called miniature termination systems or high density systems where elements are quite close together.

One of the most important (if not the most important) performance factors relates to contact resistance. More accurately, this factor relates to the change in contact resistance between the terminated wire and the terminating system after being subject to time and hostile environments.

The physical strength and durability of the connection between the wire and the termination system is also important.

Other factors relate to manufacturability and within that general subject, to the level of confidence found for terminations passing the various acceptance tests. It should be understood that with high volume production, the number of faulty pieces should be small and predictable with high level of confidence.

The termination system described below has been found to perform very well under a variety of physical and electrical performance conditions and to meet the needs for manufacturability. In terms of change in contact resistance, under hostile environments and use tests, excellent results have been obtained.

It is further notable that termination systems of the type herein described have both civilian and military uses and are particularly used in telephone systems. Production and utilization volumes are high and reliability requirements within the performance parameters specified by users are very stringent. In one exemplary application, the criterion set is that, under the defined test conditions, no more than 1 out of 10,000 terminations may exceed a change in contact resistance of 0.25 milliohms at the 95% confidence level.

SUMMARY OF THE INVENTION

The invention comprises an electrical termination system in which the wire receiving portion is defined by spaced apart sides for receiving a wire between them and at least one pair of formed-in jaws in the sides. The jaws are formed opposite each other presenting a narrowed space between them. The formed-in jaws are integral with the sides at each of their lateral extremities. In a further aspect, a lead-in portion is provided by notching the sides at the jaws establishing an angle to the upper space of the jaws to aid in locating the wire and directing it into the jaws. In the area which contacts the wire, the lead-in edge desirably has a transition portion which comprises a coined edge in order to present to an entering wire a smoothly angled embossing surface. In addition, the jaws may be freed at their lower ends.

DETAILED DESCRIPTION OF THE PREFERRED EMBODIMENTS

Figure 1:
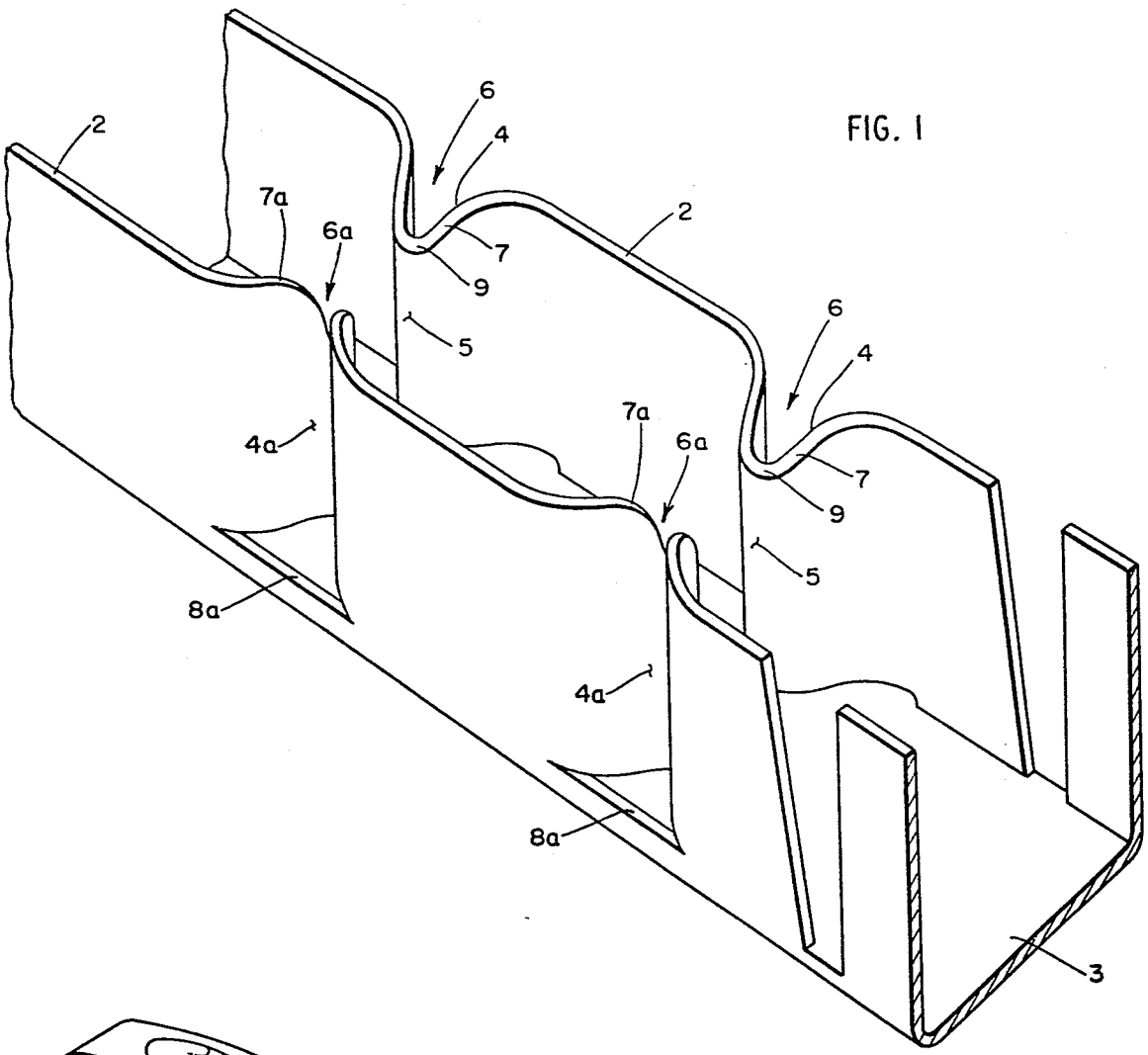
FIG. 1 is a perspective view of a preferred embodiment of the termination system of the invention.
Figure 7:
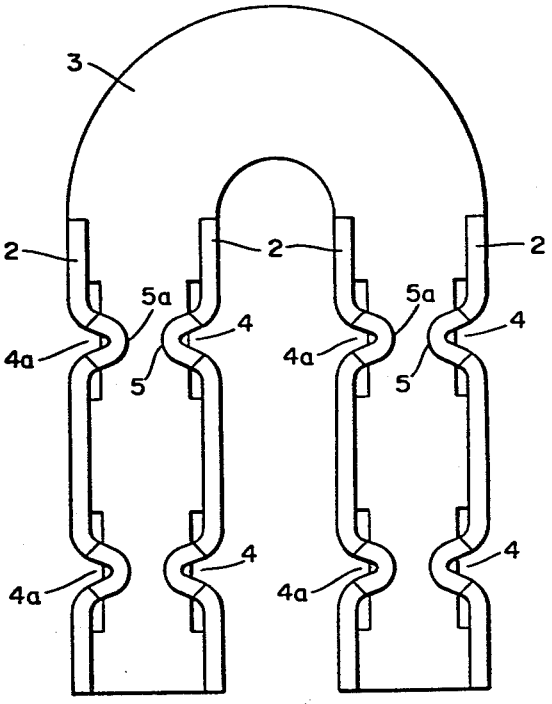
FIG. 7 shows a top view of the invention employed for splicing parallel wires.
Figure 8:
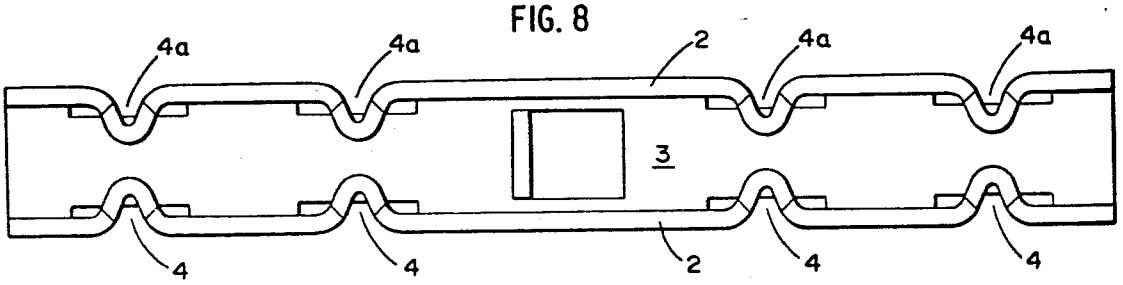
FIG. 8 shows a top view of the invention employed for butt splicing.

In the drawings, in FIG. 1, the termination system is illustrated without reference to any specific application. In FIGS. 7 and 8 the termination system is schematically illustrated as employed as a slicing means for parallel wires and butting wires, respectively.

Figure 2:
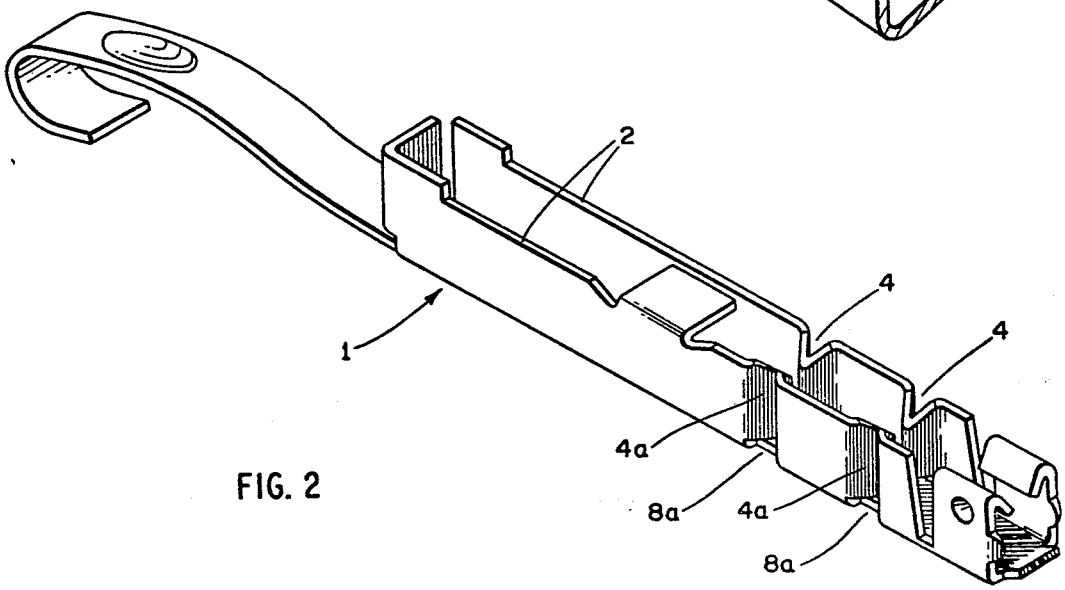
FIG. 2 is a perspective view of another preferred embodiment of the termination system of the invention as embodied in a ribbon type contact element.
Figure 3:
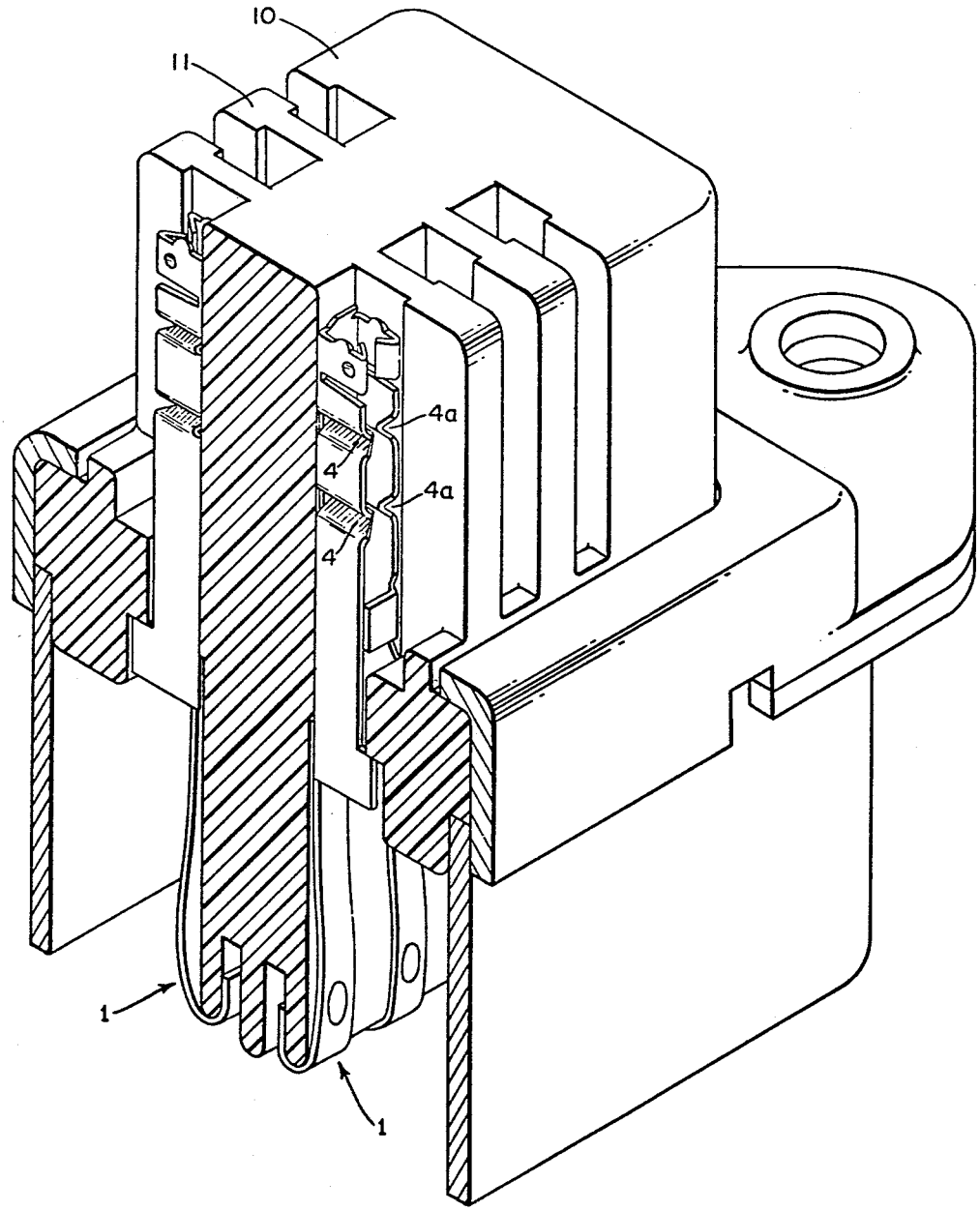
FIG. 3 is a perspective view of the contact element of FIG. 2 installed in a high density connector body.

In FIGS. 2 and 3, the system is illustrated as employed as a termination or wire receiving end of a ribbon type contact element 1. FIG. 3 shows how such a contact element may be used in a high density connector system.

By this, it should be evident that the invention has wide utility as a termination system. However, it is emphasized that the greatest advantages are seen when it is used in a miniaturized application where there is required strength, reliability and manufacturability of very small parts made from otherwise relatively weak materials.

Referring to FIG. 1, the termination system illustrated has spaced apart generally parallel sides 2 and a bottom 3 forming an elongated wire receiving channel. Pairs of oppositely facing formed-in jaws 4, 4*a* are formed-in and integral with each of the sides 2. Two pairs of jaws 4, 4*a* are shown although one pair or more than two pair could be used. By formed-in, it is meant that the metal of the sides is not cut or otherwise interrupted but is, rather, stretched and/or bent and thereby formed into the continuous curved jaws attached to and integral with the sides 2 at each of its lateral extremities. Thus, the jaws 4, 4*a* present laterally smoothly curved opposing formations having working faces 5, 5*a* as shown.

Figure 4:
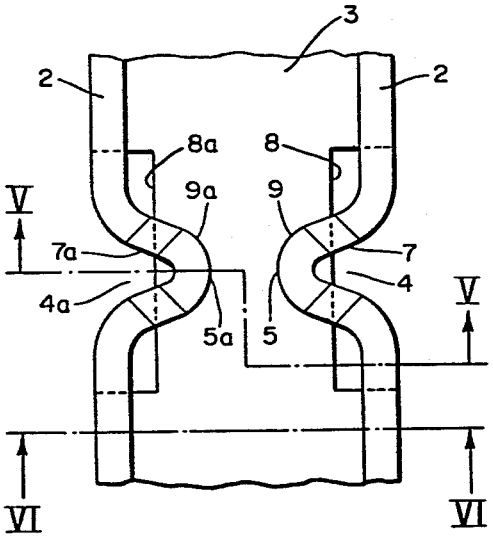
FIG. 4 is a partial top view of the preferred embodiment of the invention.
Figure 5:
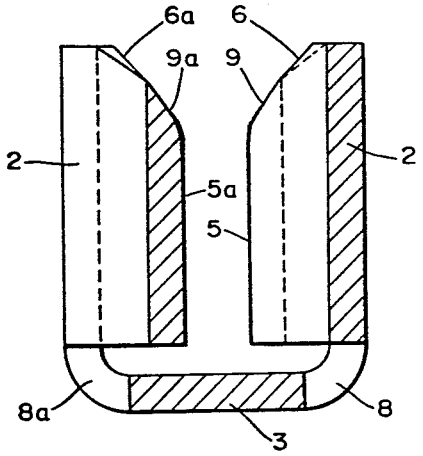
FIG. 5 is an enlarged partial section end view of the preferred embodiment of the invention through V—V of FIG. 4.
Figure 6:
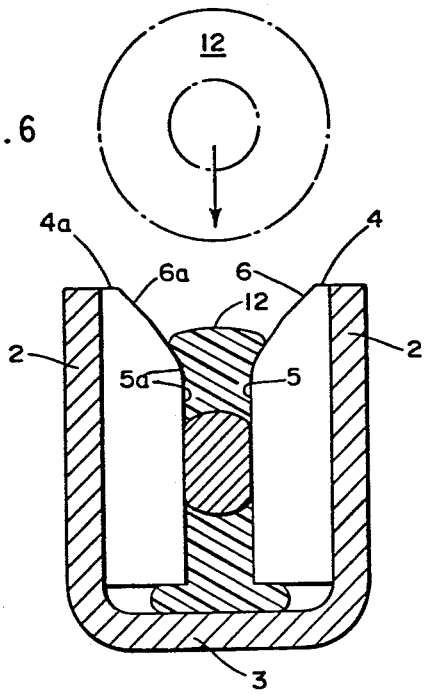
FIG. 6 is a sectional end view through VI—VI of FIG. 4 of the termination system with a wire installed, and illustrating in phantom the wire prior to installation.

In order to best explain the lead-in portion 6, 6*a* of the terminating system, it is helpful to describe some of the steps in making the system. Basically, it is punched, bent and formed from flat sheets. The lead-in 6, 6*a* is preferably made by punching a V-shaped notch prior to the forming-in of the jaws (and also before bending up the sides) so that after the jaw is formed, the upper edge 7, 7*a* of the sides extends angularly downward and inward following the plan of the jaw and as best seen in FIGS. 4, 5 and 6.

As shown in FIG. 1, slots 8, 8*a* are formed in the sides 2 in order to free the lower end of the jaws 4, 4*a* from the sides. As shown in FIGS. 2, 4 and 5 the slot 8, 8*a* is a piece of the sheet removed at the bend in the channel between the sides 2, 2*a* and the bottom 3. With the particular embodiment shown here involving a 90° bend and the bottom 3 being very close to the lower end of the jaws, it is very important to free the lower end of the jaws in order to prevent excessive stretching and random formations of the metal. It may be possible, where more free area is available below the jaw, to omit freeing it, although the freeing is still preferred.

Figure 9:
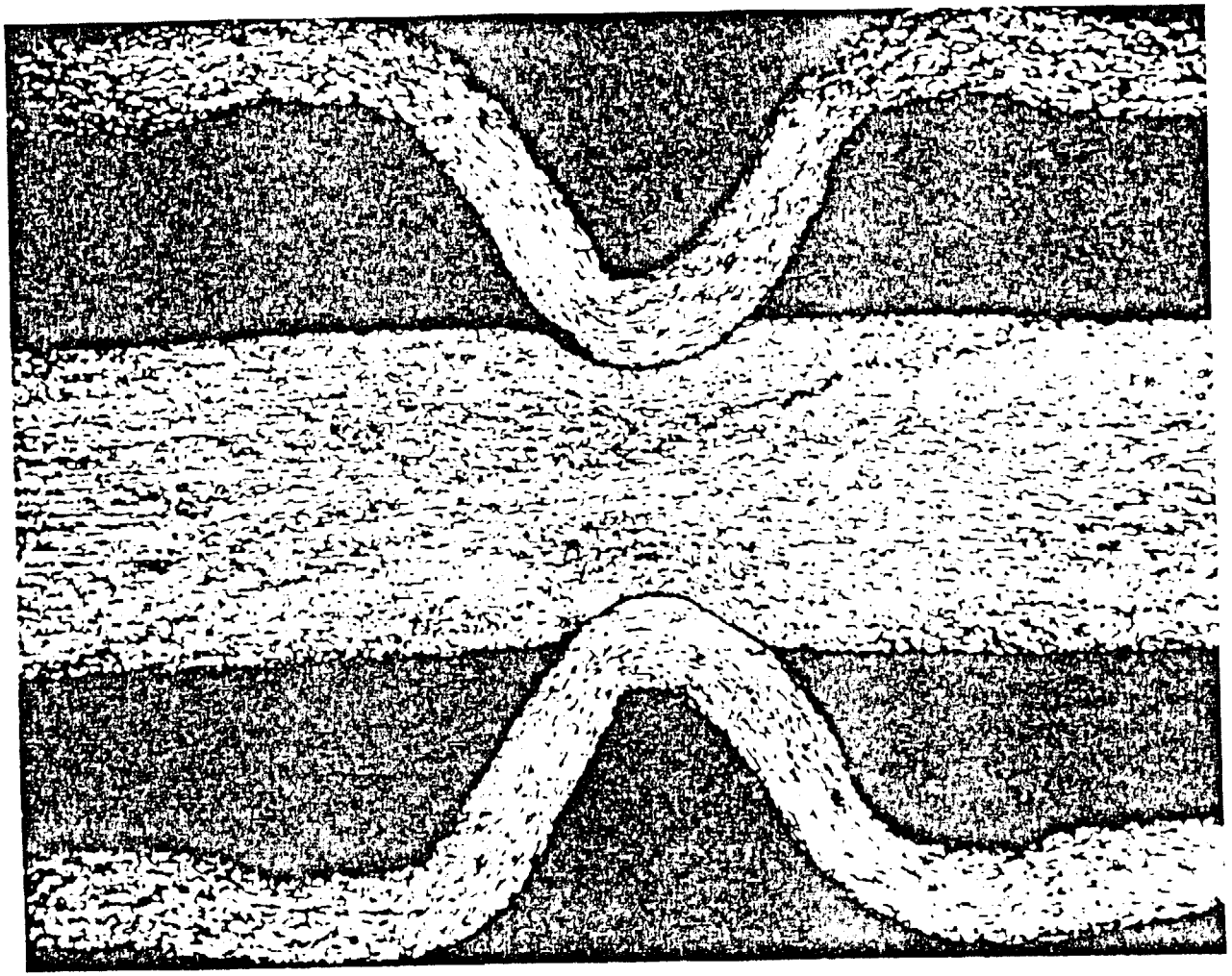
FIG. 9 is a photomicrograph of a longitudinal cross section of 24 gauge wire inserted in a termination system. The insulation does not appear in the picture.

As can be seen in the photomicrograph of FIGS. 9 and 11*a* substantially smooth continuous distortion of the wire is achieved by this system. Referring to FIG. 5, in order to facilitate such a smooth distortion, the lead-in portion has a transition area 9, 9*a* to change the angle of the edge to present an angled embossing surface to the wire at the upper edge of the jaw in the working area. It may be formed by a coining operation in the formation of the piece where the edge 7, 7*a* has its angle changed to follow the shape of the lead-in portion 6, 6*a* as seen in FIG. 5. This transition area 9, 9*a* is so designated because it is an area of transition from contact, by a wire being inserted, with the upper edge 7, 7*a* of the jaw to contact with its working face 5, 5*a*. Thus, the transition area is formed at the innermost area of the jaw defined by the working face 5, 5*a* of the jaw. The transition area, presenting an angled embossing surface, tends to cause compressive forces on the wire, aiding in the desirable relatively smooth distortion of the wire when it is eventually fully inserted. Without the transition area, a sharp corner at the upper edge of the jaw over the working faces 5, 5*a* would be presented to a wire which would tend to shear and sharply shape the wire.

The lead-in area 6, 6*a* including the coined transition portion is preferably at about a 45° angle to horizontal. It may be preferably to make the transition area present an even steeper angle to a wire between the upper edge and the working face of the jaw in order to enhance its transition effect. Other methods may be employed to form the transition area 9, 9*a* such as by forming the V notch of the lead-in area with an angled edge instead of a square cut edge. It is intended to define the transition area therefor as effecting a smooth continuation of the upper edge and into transition to the working face of the jaw.

It is for many applications important to provide some strain relief in combination with this termination system. A strain relief means suitable with the present termination system shown at 13 in FIG. 2 and 3. This strain relief is fully described in co-pending application, Ser. No. 443,730, now U.S. Pat. No. 3,902,154.

In the preferred commercial embodiment, such as illustrated in FIGS. 2 and 3 for a ribbon type contact element, the contact element may be formed from 0.006 inch cadmium bronze sheet. The contact will usually be gold plated either in its entirety or selectively on the mating portion, or both fully and selectively plated. In a primary use in telephone systems employing 24 gauge and/or 26 gauge solid insulated wire, the space between the jaws can be about 0.007 inch.

The tab 14 is provided to hold the contact element in place in the insulating connector body. A similar tab 15 is formed up in the butt splicing embodiment of FIG. 8 to hold the part in place in an associated body member.

FIG. 3 shows part of a 50 contact polarized ribbon type connector. This is a type of high density connector commonly used in rack-and-panel and cable-to-cable applications in telephone systems. In an exemplary case, the contact elements are on 0.085 inch centers. The contact elements 1 are mounted in two parallel rows in the insulator 10 between the ribs 11. The contact elements 1 reside in channels defined, at the wire termination end, by ribs 11. The ribs 11 provide support for the sides 2, 2*a* of the termination systems, serving to rigidly back the sides 2 in order to prevent their spreading apart when a wire is inserted.

To use the connector, the completed connector is held firmly and wires inserted either singly or multiply, one into each contact element.

An exact procedure and means for inserting the wire is more fully described in co-pending application, Ser. No. 502,085, which has been abandoned in favor of pending divisional application Ser. No. 585,308, now U.S. Pat. No. 4,001,931 and pending continuation application Ser. No. 586,453, now U.S. Pat. No. 3,965,558. For the present description, it is sufficient to understand that the wire 12 is positioned as shown in FIG. 6 over the channel and, with a tool designed to do so, evenly pushed down into the channel.

Figure 10:
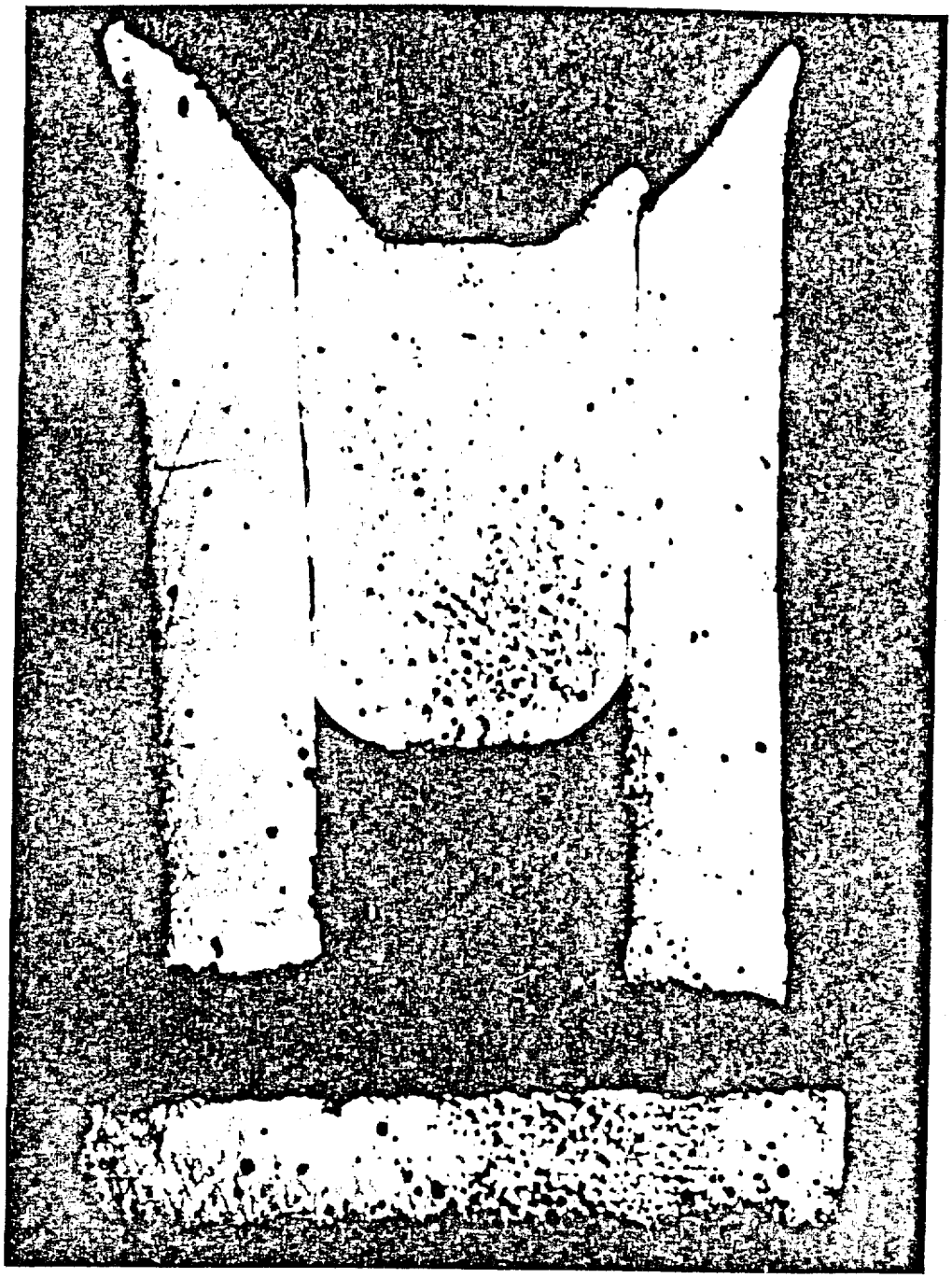
FIG. 10 is a photomicrograph of a right angle cross section view of 24 gauge wire inserted in a termination system. The insulation does not appear in the picture.

As can be appreciated, the smoothly angled configuration of the upper edge 7, 7*a* f the jaw will contact the insulation on the wire and, as the wire is pushed downward, will tear through the insulation. As the wire progresses downward and the metal of the wire itself contacts the jaws commencing past the transition area 9, 9*a* and to the working faces 5, 5*a*, it will be deformed to eventually mate intimately with the jaw working faces 5, 5*a*. The primary distortion of the wire is an inward compression or embossing with some upward displacement of metal. The photomicrographs of FIGS. 9 and 10 show the configuration of the jaw and the wire as it resides in place. An intimate, largely compressive contact of the wire with the jaws is evident. In the horizontal direction, as shown in FIG. 9, the metal is distorted inward in a smoothly curved pattern preserving the axially fibrous structure of the wire and avoiding stress concentration points. In the vertical direction, while some upward displacement is seen, nevertheless, the embossing nature of the distortion can be seen.

In an intensive series of tests involving a variety of hostile environments, thermal cycling, thermal shock, thermal anging and physical strength and durability the termination system performed well according to criteria relevant to telecommunications applications.

While the above description relates to certain embodiments now known to and preferred by the inventors, it is possible for persons skilled in the art to make certain additions, changes and modifications. It is intended by the appended claims to cover such additions, changes and modifications as fall within the scope and spirit of the invention.

We claim:

1. The method of making an electrical wire termination system comprising:
   forming a flat sheet of metal into an elongated wire receiving body having a bottom and facing sides defining a wire receiving channel;
   notching the sides from their upper edges at areas at which jaws are to be formed;
   forming-in at least one pair of wire contacting jaws, the jaws being oppositely positioned and extending transversely of the side and into the wire receiving channel, to receive and hold a wire inserted in the wire receiving channel when the body is formed, and the notches providing a lead-in portion on each jaw, wherein the notch edges form upper edges of the jaws and extend from the side inwardly and downwardly into the wire receiving channel; and
   coining the edge of each of said notches at its apex so that said edge presents a uniform angular lead-in to the wire being inserted and facilitates the compression and deformation of the wire being inserted.

2. The method of claim 1 further comprising freeing the jaw from the side at its lower extremity by an axially extending cut in the side prior to forming-in the jaw.

3. A method for making wire terminations for use in electrical connectors comprising the steps of:
   cutting a flat sheet of metal to form a blank having on one planar surface thereof first, second and third generally rectangular portions in a parallel linear array;
   cutting V-shaped notches along the outer edges of said first and third portions;
   deforming said first and third portions, without cutting or breaking said metal, to form curved ridges on said surfaces extending transversely across said first and third rectangular portions from the outer edges thereof to said second portion;
   coining each of said V-shaped notches at its apex; and
   bending said metal blank into an elongated channel having a bottom defined by said second portion and opposing sides defined by said first and third portions, said curved ridges being so formed on said surfaces as to define opposing jaws for receiving and holding a wire inserted in said channel;
   said deforming of said first and third rectangular portions being performed at corresponding locations equidistant along the axial length of the channel so that, upon forming, said ridges define paired jaws linearly disposed across said channel from each other and said notches are at the location of the deformation so as to define a tapered lead-in area for guiding said wire between said jaws upon insertion, the coined edges of said notches extending from the side inwardly and downwardly into the wire-receiving channel to present a uniform angular lead-in to said wire inserted in said channel and to facilitate compression and deformation of the wire being inserted.

4. The method of claim 3 further including the step of axially cutting the blank at the inner edge of the said first and third portions adjacent the area to be deformed prior to the deforming step so as to allow the deformation to occur independent of the bottom of the channel.

5. The method of making an electrical wire termination system comprising:
   forming a flat sheet of metal into an elongated wire receiving body having a bottom and facing sides defining a wire receiving channel;
   notching the sides from their upper edges at areas at which jaws are to be formed; and
   forming-in at least one pair of wire contacting jaws, the jaws being oppositely positioned and extending transversely of the side and into the wire receiving channel, to receive and hold a wire inserted in the wire receiving channel when the body is formed, the oppositely-positioned jaws being so formed as to be sufficiently rigid to facilitate the compression and substantial deformation of the wire being inserted and the notches providing a lead-in portion on each jaw wherein the notch edges form upper edges of the jaws and extend from the side inwardly and downwardly into the wire receiving channel.

6. A method for making wire terminations for use in electrical connectors comprising the steps of:
   cutting a flat sheet of metal to form a blank having on one planar surface thereof first, second and third generally rectangular portions in a parallel linear array;
   cutting V-shaped notches along the outer edges of said first and third portions;
   deforming said first and third portions, without cutting or breaking said metal, to form curved ridges on said surfaces extending transversely across said first and third rectangular portions from the outer edges thereof to said second portion; and
   bending said metal blank into an elongated channel having a bottom defined by said second portion and opposing sides defined by said first and third portions, said curved ridges being so formed on said surfaces as to define opposing rigid jaws for receiving and holding a wire inserted in said channel, said opposing jaws being sufficiently rigid to facilitate the compression and substantial deformation of the wire being inserted;
   said deforming of said first and third rectangular portions being performed at corresponding locations equidistant along the axial length of the channel so that, upon forming, said ridges define paired jaws linearly disposed across said channel from each other and said notches are at the location of deformation so as to define a tapered lead-in area for guiding said wire between said jaws upon insertion, the edges of said notches extending from the side inwardly and downwardly into the wire-receiving channel.

7. The method of making an electrical wire termination system comprising:
   forming a flat sheet of metal into an elongated wire receiving body having a bottom and facing sides defining a wire receiving channel;
   notching the sides from their upper edges at areas at which jaws are to be formed; and
   forming-in at least one pair of wire contacting jaws, the jaws being oppositely positioned and extending transversely of the side and into the wire receiving channel, to receive and hold a wire inserted in the wire receiving channel when the body is formed, the oppositely-positioned jaws being so formed as to be separated by a space sufficiently less than the diameter of the wire being inserted prior to insertion to facilitate the compression and deformation of the wire being inserted, and the notches providing a lead-in portion on each jaw, wherein the notch edges form upper edges of the jaws and extend from the side inwardly and downwardly into the wire receiving channel.

8. A method for making wire terminations for use in electrical connectors comprising the steps of:

cutting a flat sheet of metal to form a blank having on one planar surface thereof first, second and third generally rectangular portions in a parallel linear array;

cutting V-shaped notches along the outer edges of said first and third portions;

deforming said first and third portions, without cutting or breaking said metal, to form curved ridges on said surface extending transversely across said first and third rectangular portions from the outer edges thereof to said second portion; and bending said metal blank into an elongated channel having a bottom defined by said second portion and opposing sides defined by said first and third portions, said curved ridges being so formed on said surfaces as to define opposing jaws for receiving and holding a wire inserted in said channel, said opposing jaws being separated by a space sufficiently less than the diameter of the wire being inserted prior to insertion to facilitate the compression and deformation of the wire being inserted;

said deforming of said first and third rectangular portions being performed at corresponding locations equidistant along the axial length of the channel so that, upon forming, said ridges define paired jaws linearly disposed across said channel from said other and said notches are at the location of deformation so as to define a tapered lead-in area for guiding said wire between said jaws upon insertion, the edges of said notches extending from the side inwardly and downwardly into the wire-receiving channel.

9. The method of making an electrical wire termination system comprising:

forming a flat sheet of metal into an elongated wire receiving body having a bottom and facing sides defining a wire receiving channel;

notching the sides from their upper edges at areas at which jaws are to be formed;

forming-in at least one pair of wire contacting jaws, the jaws being oppositely positioned and extending transversely of the side and into the wire receiving channel, to receive and hold a wire inserted in the wire receiving channel when the body is formed, the oppositely-positioned jaws being so formed as to be sufficiently rigid and separated by a space sufficiently less than the diameter of the wire being inserted prior to insertion to facilitate the compression and substantial deformation of the wire being inserted, and the notches providing a lead-in portion on each jaw wherein the notch edges form upper edges of the jaws and extend from the side inwardly and downwardly into the wire receiving channel; and coining the edge of each of said notches at its apex so that said edge presents a uniform angular lead-in to the wire being inserted and facilitates compression and substantial deformation of the wire being inserted.

10. A method for making wire terminations for use in electrical connectors comprising the steps of:

cutting a flat sheet of metal to form a blank having on one planar surface thereof first, second and third generally rectangular portions in a parallel linear array;

cutting V-shaped notches along the outer edges of said first and third portions;

deforming said first and third portions, without cutting or breaking said metal, to form curved ridges on said surface extending transversely across said first and third rectangular portions from the outer edges thereof to said second portion;

bending said metal blank into an elongated channel having a bottom defined by said second portion and opposing sides defined by said first and third portions, said curved ridges being so formed on said surfaces as to define opposing rigid jaws for receiving and holding a wire inserted in said channel, said opposing jaws being sufficiently rigid and being separated by a space sufficiently less than the diameter of the wire being inserted prior to insertion to facilitate the compression and substantial deformation of the wire being inserted;

coining the edge of each of said V-shaped notches at its apex so that said edge presents a uniform angular lead-in to the wire being inserted and facilitates the compression and substantial deformation of the wire being inserted; and said deforming of said first and third rectangular portions being performed at corresponding locations equidistant along the axial length of the channel so that, upon forming, said ridges define paired jaws linearly disposed across said channel from each other and said notches are at the location of deformation so as to define a tapered lead-in area for guiding said wire between said jaws upon insertion, the edges of said notches extending from the side inwardly and downwardly into the wire-receiving channel.

11. The method of making an electrical wire termination system comprising:

forming a flat sheet of metal into an elongated wire receiving body having a bottom and facing sides defining a wire receiving channel;

forming V-shaped notches in the sides from their upper edges at areas at which jaws are to be formed, said notches being so formed as to have angled edges; and forming-in at least one pair of wire contacting jaws, the jaws being oppositely positioned and extending transversely of the side and into the wire receiving channel, to receive and hold a wire inserted in the wire receiving channel when the body is formed, and the notches providing a lead-in portion on each jaw, wherein the angled notch edges form upper edges of the jaws and extend from the side inwardly and downwardly into the wire receiving channel and present a uniform angular lead-in to the wire being inserted and facilitate compression and deformation of the wire being inserted.

12. A method for making wire terminations for use in electrical connectors comprising the steps of:

cutting a flat sheet of metal to form a blank having on one planar surface thereof first, second and third generally rectangular portions in a parallel linear array;

cutting V-shaped notches along the outer edges of said first and third portions, said notches being so cut as to have angled edges;

deforming said first and third portions, without cutting or breaking said metal, to form curved ridges on said surface extending transversely across said first and third rectangular portions from the outer edges thereof to said second portion; and bending said metal blank into an elongated channel having a bottom defined by said second portion and opposing sides defined by said first and third portions, said curved ridges being so formed on said surfaces as to define opposing jaws for receiving and holding a wire inserted in said channel;

said deforming of said first and third rectangular portions being performed at corresponding locations equidistant along the axial length of the channel so that, upon forming, said ridges define paired jaws linearly disposed across said channel from each other and said notches are at the location of deformation so as to define a tapered lead-in area for guiding said wire between said jaws upon insertion, the angled edges of said notches extending from the side inwardly and downwardly into the wire-receiving channel to present a uniform angular lead-in to said wire inserted in said channel and to facilitate compression and deformation of the wire being inserted.

13. A wire termination element for electrically engaging an insulation-covered conductor by compressive deformation thereof, said termination element comprising:

an elongated wire receiving body formed from a flat sheet of metal to have a bottom and facing sides defining a wire receiving channel;

at least one notch along the upper edge of each of said facing sides;

at least one pair of wire contacting jaws formed from said facing sides at said notches, said jaws being oppositely positioned across said channel and extending transversely of the sides and into the wire receiving channel to receive and hold the wire inserted in the wire receiving channel, said notches providing an angular lead-in portion on each jaw, such that the notched edges form upper edges of the jaws and extend from the side inwardly and downwardly into the wire receiving channel; and a coined surface at the apex of each of said notches providing a uniform angular lead-in at the upper edge of each jaw so as to facilitate the compression and deformation of the conductor upon its insertion into the channel.

14. A wire termination element according to claim 13 wherein each of said jaws is freed from its associated facing side at its lower extremity by an axially extending cut to allow forming-in of the jaw independent of said channel bottom.

15. For us in an electrical connector, a wire termination element for electrically engaging an insulation-covered conductor by compressive deformation thereof, said termination element comprising:

an elongated channel formed from a flat sheet metal blank which is cut to define on one planar surface thereof first, second and third generally rectangular portions disposed in a parallel linar array;

V-shaped notches cut along the outer edges of said first and third rectangular portions;

curved ridges formed inward from said first and third rectangular portions, without cutting or breaking said metal, and extending transversely across said first and third rectangular portions from said V-shaped notches to said second portion; and a coined edge formed along the apex of each of said V-shaped notches;

said curved ridges being formed on said first and third rectangular portions at corresponding locations equidistant along the axial length of said channel so that said ridges define curved jaws linearly disposed across said channel from each other, and said notches being cut at the location of said ridges so as to define a tapered lead-in area for guiding said wire between said jaws upon insertion, the coined edges of said notches extending from the side inwardly and downwardly into the wire-receiving channel to present a uniform angular lead-in to said wire inserted in said channel and to facilitate compression and deformation of the conductor upon insertion.

16. A wire termination element for electrically engaging an insulation-covered conductor by compressive deformation thereof, said termination element comprising:

an elongated wire receiving body formed from a sheet of metal into a wire receiving channel defined by a bottom and facing sides:

at least one notch cut along the upper edge of each of said facing sides;

at least one pair of wire contacting jaws formed-in from said facing sides, the jaws being oppositely positioned and extending transversely of said sides and into the wire receiving channel to receive and hold a wire inserted in the wire receiving channel, the oppositely positioned jaws being so formed as to be sufficiently rigid to facilitate the compression and substantial deformation of the conductor being inserted and the notches providing a lead-in portion on each jaw wherein the notch edges form upper edges of the jaws and extend from the side inwardly and downwardly into the wire receiving channel.

17. An electrical wire termination element for engaging an insulation-covered conductor by compressive deformation thereof, said termination element comprising:

an elongated wire receiving body formed from a flat sheet of metal into a channel having a bottom and facing sides;

at least one notch cut into each of said sides along the upper edge thereof; and at least one pair of wire contacting jaws formed in opposing relationship from said sides at the location of said notches for receiving and holding a wire inserted in the wire receiving channel, the oppositely positioned jaws being formed vertically across said sides without cutting or breaking said sides and being separated by a space sufficiently less than the diameter of the wire being inserted so as to facilitate the compression and deformation of the inserted conductor, the notches providing a lead-in portion on each jaw, whereby the notch edges form upper edges of the jaws and extend from the side inwardly and downwardly into the wire receiving channel.

18. A wire termination element for electrically engaging an insulation-covered conductor by compressive deformation thereof, said termination element compressing:

an elongated wire receiving body having a bottom and facing sides formed from a flat sheet of metal to define a wire receiving channel;

at least one V-shaped notch cut along the upper edge of each of said facing sides;

at least one pair of contacting jaws formed in from said sides at the location of said notches, the jaws being oppositely positioned and extending vertically across the sides and into the wire receiving channel to receive and hold a wire inserted in the wire receiving channel, the oppositely positioned jaws being so formed as to be sufficiently rigid and separated by a space sufficiently less than the diameter of the wire being inserted to facilitate the compression and substantial deformation of the conductor during its insertion, the notches providing an angular lead-in portion at the top of each jaw and the notch edges forming upper edges of the corresponding jaws and extending from the sides inwardly and downwardly into the wire receiving channel; and a tapered embossing surface formed across the edge of the metal at the apex of each of said notches and formed at the angle of said lead-in to further facilitate the compression and substantial deformation of the conductor upon its insertion between the jaws.

* * * * *

UNITED STATES PATENT OFFICE

CERTIFICATE OF CORRECTION

Patent No. 4,040,702 Dated August 9, 1977

Inventor(s) William H. McKee et al.

It is certified that error appears in the above-identified patent and that said Letters Patent are hereby corrected as shown below:

Column 2, line 12, "space" should read -- edge --.

Column 2, line 55, "slicing" should read -- splicing --.

column 2, line 63, "termination" should read -- terminating --.

Column 3, line 38, "11a" should read -- 11 a --.

Column 3, line 62, "preferably" should read -- preferable --.

Column 4, line 50, "f" should read -- of --.

Column 5, line 3, "anging" should read -- aging --.

Column 5, line 47, (Claim 3), "surfaces" should read -- surface--.

Column 6, line 37, (Claim 6), "surfaces" should read -- surface --.

Column 7, line 40, (Claim 8, "said", second occurrence, should read -- each --.

Column 9, line 63, (Claim 15), "us" should read -- use --.

Column 11, lines 5 and 6, (Claim 18), "compressing" should read -- comprising --.

UNITED STATES PATENT OFFICE

CERTIFICATE OF CORRECTION

Patent No. 4,040,702 Dated August 9, 1977

Inventor(s) William H. McKee et al.

It is certified that error appears in the above-identified patent and that said Letters Patent are hereby corrected as shown below:

In the drawings:

"Sheet 1 of 3" should read -- Sheet 1 of 6 --.

"Sheet 2 of 3" should read -- Sheet 2 of 6 --.

"Sheet 3 of 3" should read -- Sheet 3 of 6 --.

Figure 11:
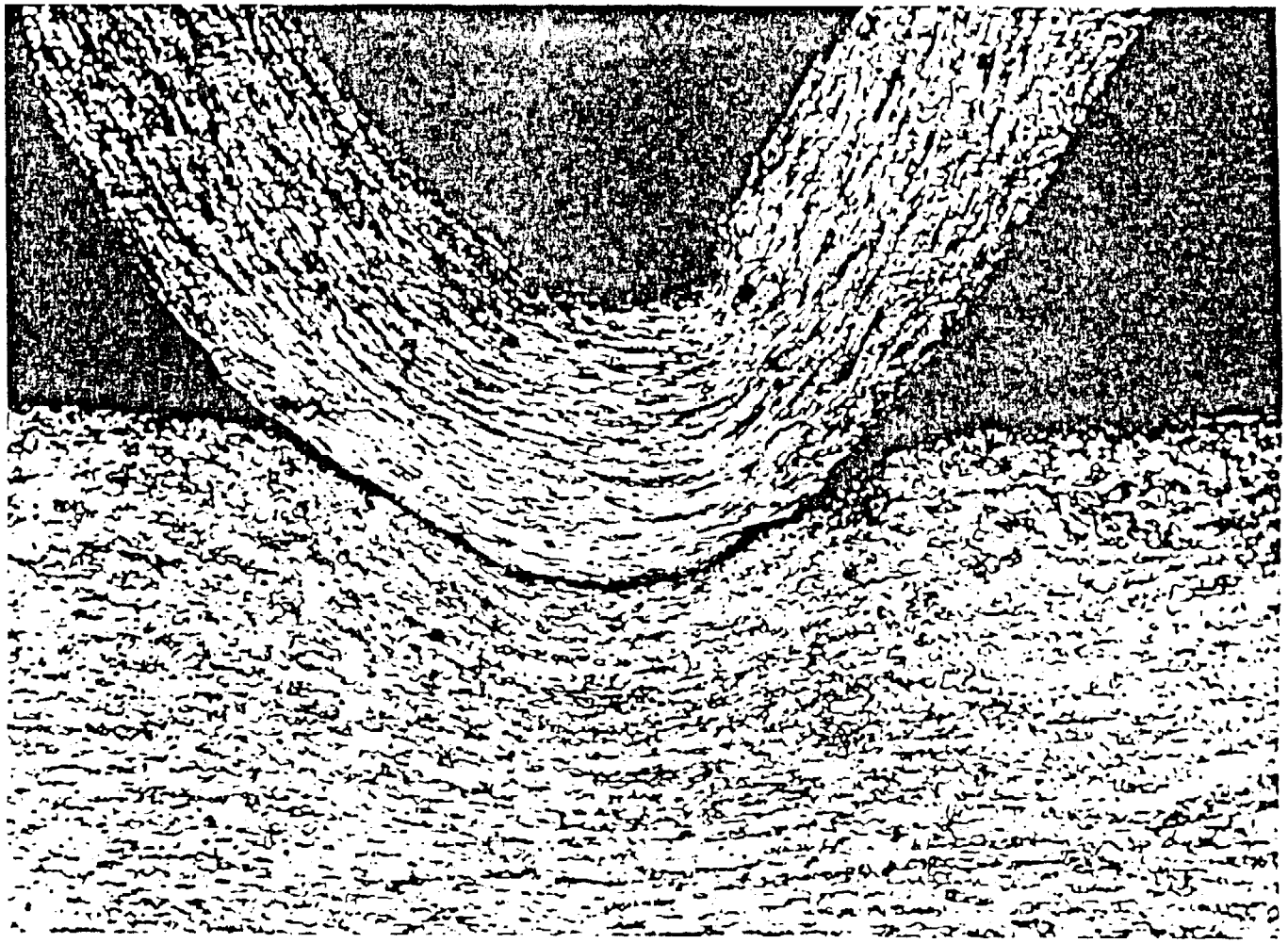
FIG. 11 is an enlarged photomicrograph of a longitudinal cross section, as shown in FIG. 9.

Add Sheets 4, 5 and 6, containing FIG. 9, 10 and 11, as shown on the attached sheets.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*